US007562709B2

(12) United States Patent
Saebi et al.

(10) Patent No.: US 7,562,709 B2
(45) Date of Patent: Jul. 21, 2009

(54) GRAVEL PACK APPARATUS THAT INCLUDES A SWELLABLE ELEMENT

(75) Inventors: Shahryar Saebi, Kuala Belait (BN); Ezio Toffanin, Stavanger (NO); Raymond J. Tibbles, Kuala Lumpur (MY)

(73) Assignee: Schlumberger Technology Corporation, Sugar Land, TX (US)

( * ) Notice: Subject to any disclaimer, the term of this patent is extended or adjusted under 35 U.S.C. 154(b) by 105 days.

(21) Appl. No.: 11/841,195

(22) Filed: Aug. 20, 2007

(65) Prior Publication Data

US 2008/0066900 A1 Mar. 20, 2008

Related U.S. Application Data

(60) Provisional application No. 60/826,191, filed on Sep. 19, 2006.

(51) Int. Cl.
*E21B 43/04* (2006.01)
*E21B 33/12* (2006.01)

(52) U.S. Cl. ..... 166/278; 166/51; 166/179; 166/387

(58) Field of Classification Search ..... 166/278, 166/51, 179, 387
See application file for complete search history.

(56) References Cited

U.S. PATENT DOCUMENTS

| | | | | |
|---|---|---|---|---|
| 4,945,991 | A | 8/1990 | Jones | |
| 5,588,487 | A | 12/1996 | Bryant | |
| 6,298,916 | B1 * | 10/2001 | Tibbles et al. | 166/278 |
| 6,311,772 | B1 | 11/2001 | Myhre | |
| 7,152,677 | B2 | 12/2006 | Parlar | |
| 2005/0039917 | A1 | 2/2005 | Hailey | |
| 2005/0045327 | A1 | 3/2005 | Wang | |
| 2005/0045329 | A1 | 3/2005 | Wetzel | |
| 2005/0082061 | A1 | 4/2005 | Nguyen | |
| 2005/0199401 | A1 * | 9/2005 | Patel et al. | 166/387 |
| 2005/0279501 | A1 | 12/2005 | Surjaatmadja | |

FOREIGN PATENT DOCUMENTS

| | | | |
|---|---|---|---|
| WO | 2004094769 | A2 | 11/2004 |
| WO | 2004094769 | A3 | 11/2004 |
| WO | 2005031105 | A2 | 4/2005 |
| WO | 2005031105 | A3 | 4/2005 |
| WO | 2005042909 | A2 | 5/2005 |
| WO | 2005042909 | A3 | 5/2005 |

OTHER PUBLICATIONS

Schlumberger Brochure TSL-4551, "Alternate Path Technology, Higher Production From Gravel-Packed Wells", May 2001.

* cited by examiner

*Primary Examiner*—Giovanna C Wright
(74) *Attorney, Agent, or Firm*—Jeremy P. Welch; James L. Kurka; Trop, Pruner & Hu P.C.

(57) ABSTRACT

A gravel pack apparatus for use in a wellbore includes a screen assembly to filter particulates, at least one shunt conduit to carry gravel slurry, and a swellable element around a portion of the at least one shunt conduit. The swellable element swells in response to an input stimulus and expands radially outwardly to seal against the wellbore.

21 Claims, 4 Drawing Sheets

GRAVEL PACK APPARATUS THAT INCLUDES A SWELLABLE ELEMENT

CROSS-REFERENCE TO RELATED APPLICATION

This claims the benefit under 35 U.S.C. § 119(e) of U.S. Provisional Application Ser. No. 60/826,191, entitled "Sand Control Completion with Interval Isolation," filed Sep. 19, 2006, which is hereby incorporated by reference.

TECHNICAL FIELD

The invention relates generally to a gravel pack apparatus and method that includes a swellable element that swells in response to an input stimulus to seal against a wellbore.

BACKGROUND

To complete a well, one or more formation zones adjacent the wellbore are perforated to allow fluid from the formation zones to flow into the well for production to the surface. Perforations are typically created by perforating gun strings that are lowered to desired intervals in the wellbore. When fired, perforating guns extend perforations into the surrounding formation.

In producing fluids from a reservoir in a formation, particulates such as sand may be produced with reservoir fluids. Such particulates may damage the well and significantly reduce production and life of the well. Formation fluids containing particulates may act as an abrasive that wears and erodes downhole components, such as tubing. In addition, production of particulates such as sand may create voids in the formation behind the casing which may result in buckling of or other damage to the casing. Moreover, particulates produced to the surface are waste products requiring disposal, which may be costly.

Various methods and devices for reducing or eliminating sand and other particulate production have been developed. Gravel packing of the formation is a popular technique for controlling sand production. Although there are variations, gravel packing essentially involves placing a sand screen around the section of the production string containing the production inlets. This section of the production string is aligned with the perforations. A slurry of gravel in a viscous transport fluid is pumped into the annulus between the sand screen and the casing. The deposited gravel blocks the formation particulates, such as sand, from flowing into the production tubing. However, formation fluids are allowed to enter the production string for flow to the well surface.

In some scenarios, such as when relatively long formations are being gravel packed, it may be desirable to employ zonal isolation to define multiple zones that are isolated from each other. Conventionally, the isolation used with sand control equipment includes cup packers in cased hole applications. However, use of cup packers reduces flexibility in how zones can be isolated.

SUMMARY

In general, according to one embodiment, a gravel pack apparatus for use in a wellbore includes a screen assembly to filter particulates, and at least one shunt conduit to carry gravel slurry. A swellable element around a portion of the at least one shunt conduit swells in response to an input stimulus to seal against the wellbore, where the swellable element when swelled expands radially.

Other or alternative features will become apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments are possible.

Figure 1:
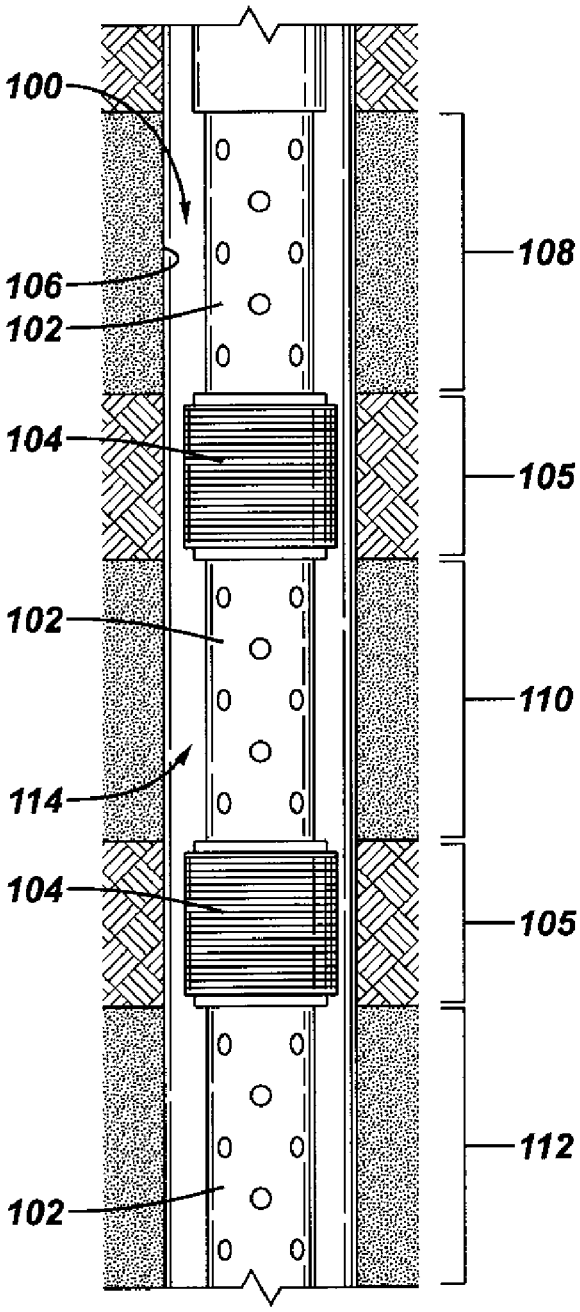
FIG. 1 illustrates a completion string having screen assemblies and swellable elements according to some embodiments.

FIG. 1 illustrates a completion string positioned in a wellbore 100, where the completion string includes screen assemblies 102 and swellable elements 104. The screen assemblies 102 include screens (or other types of filtering structures) to perform filtering of particulates such that particulates are not produced into the completion string. In a different implementation, instead of production, the completion string can be used for injecting fluids into the surrounding reservoir. The swellable elements (also referred to as swellable packers) 104 are provided to swell (from a first diameter to a second, larger diameter) in response to some type of input stimulus such that the swellable elements 104 expand to sealably engage an inner surface 106 of the wellbore 100.

The input stimulus that causes swelling of the swellable elements 104 can include stimulus due to exposure to a downhole environment (e.g., well fluids, elevated temperature, and/or elevated pressure). Exposure to the downhole environment causes expansion of the swellable elements 104. In some implementations, the swellable elements 104 are formed of elastomers that expand upon exposure to well fluids at elevated temperatures or pressures. The swelling of the swellable elements 104 is a chemical swelling process which can cause radial expansion of the swellable elements 104 to exert radial forces on the inner surface 106 of the wellbore 100 such that a sealing barrier is provided to isolate different zones of the wellbore 100. Upon swelling of the swellable elements 104, three zones 108, 110, and 112 are defined.

Note that if a different number (one or more than two) of swellable elements 104 are used, then a different number of zones are defined.

In a different implementation, chemical swelling of the swellable elements 104 can be in response to release of an activating agent. For example, the activating agent can be stored in some container that is sealed prior to activation. Upon activation, the container is opened to allow the activating agent to communicate with the swellable elements 104 such that the swellable elements 104 are caused to chemically swell. For example, a shifting tool in the completion string can be used to open the container to release the activating agent.

In yet another implementation, the swellable elements 104 can be inflatable bladders that can be filled with a fluid (e.g., gas or liquid) to cause the swellable elements 104 to expand to engage the inner surface 106 of the wellbore 100.

The benefit of using the swellable elements 104 is that during run-in of the completion string, the swellable elements 104 have an outer diameter that is less than an inner diameter of the wellbore 100. The annular clearance around the swellable elements 104 allows fluid displacement around the swellable elements 104 during run-in. Also, each swellable element 104 can have a relatively long sealing length, such as on the order of several feet. In permeable formations, the swellable elements 104 can provide reasonable isolation because pressure drop is length dependent. Moreover, swelling of each swellable element 104 provides for relatively good conformity with the inner surface 106 of the wellbore 100 (and with any gravel material in the region to be sealed) such that a good seal is provided. Also, because the swellable elements 104 are able to expand beyond the run-in outer diameter, the swellable elements can seal in a larger range of wellbore sizes. In one example, the swellable elements can be used in an under-reamed open hole. Moreover, the swellable elements 104 provide for greater flexibility in that the swellable elements 104 can be used in either a cased wellbore or in an open hole (un-cased and un-lined wellbore).

Figure 2A:
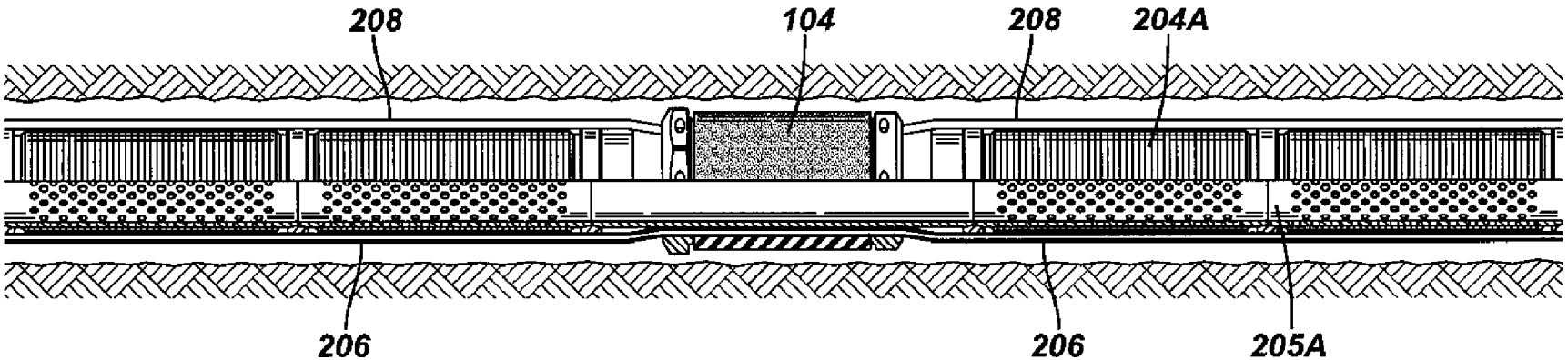
FIGS. 2A and 2B illustrate a portion of the completion string of FIG. 1, with FIG. 2A showing a swellable element prior to swelling, and FIG. 2B showing the swellable element after swelling.
Figure 2B:
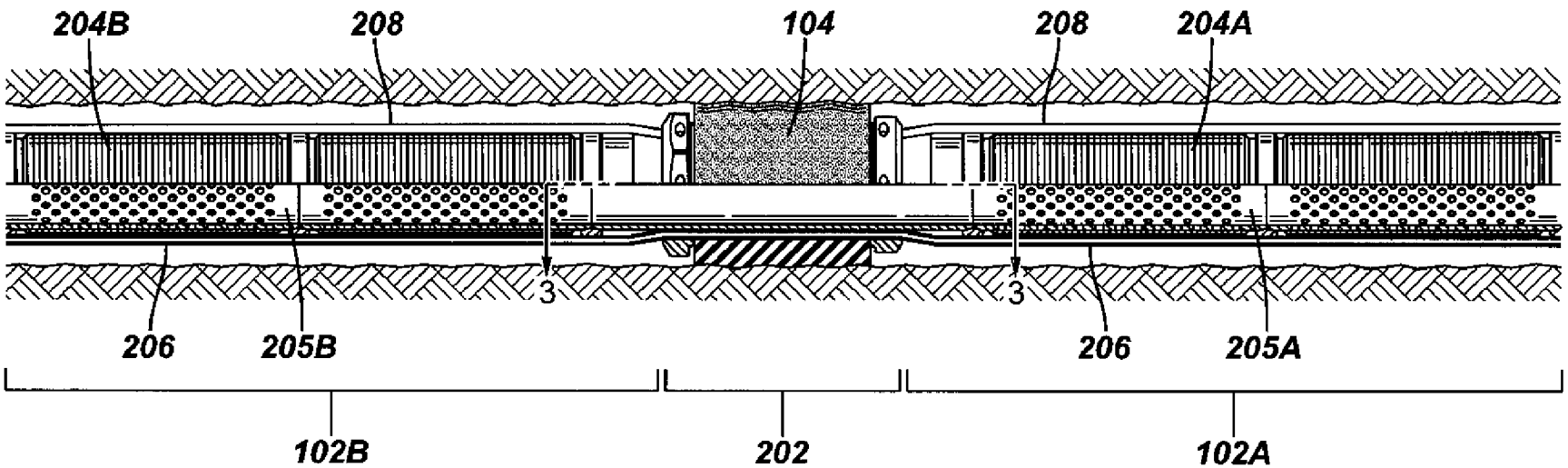

FIGS. 2A and 2B illustrate a portion (one swellable element 104 and two screen assemblies 102A and 102B on the two sides of the swellable element 104) of the completion string depicted in FIG. 1. FIG. 2A shows the swellable element 104 prior to swelling, whereas FIG. 2B shows the swellable element 104 after swelling. The swellable element 104 is mounted on a connection sub 202 that connects the first screen assembly 102A on one side of the connection sub 202, and the second screen assembly 102B on the other side of the connection sub 202. The connection sub 202 interconnects the screen assemblies 102A, 102B.

The screen assembly 102A includes a screen 204A and an outer shroud 205B that surrounds the screen 204A. The shroud 205B has multiple perforations to allow for communication of fluids. The screen 204A is used for filtering particulates such that such particulates are not produced into an inner bore of the completion string.

Also depicted in FIG. 2A are shunt conduits 206 and 208, where the shunt conduits can be shunt tubes in some embodiments. The shunt tubes 206, 208 are positioned between the outer shroud 205A and screen 204A. The shunt tubes 206, 208 are used to carry gravel slurry to provide for better gravel packing. Although not depicted in FIGS. 2A and 2B, the shunt tubes 206 and 208 have side ports that allow for gravel slurry to exit the shunt tubes at discrete locations along the shunt conduits 206, 208. In different implementations, different numbers of shunt tubes (one or more than two) can be used.

The shunt tubes 206, 208 are used to address the gravel bridging problem, in which gravel bridges are formed in an annulus region (between the completion string and wellbore surface) during a gravel packing operation. These gravel bridges block further flow of gravel slurry through the annulus region to prevent or reduce distribution of gravel past the bridge. Shunt conduits can be used to carry gravel slurry to bypass gravel bridges such that a good gravel fill can be provided throughout a wellbore interval.

As further depicted in FIG. 2A, the shunt tubes 206, 208 pass through the connection sub 202 (inside the swellable element 104), such that the swellable element 104 extends around the shunt tubes 206, 208.

The screen assembly 102B includes similar components as the screen assembly 102A, including outer shroud 205B and screen 204B. The shunt tubes 206, 208 extend through a region between the outer shroud 205B and screen 204B.

FIG. 2B shows a state after gravel packing has been performed such that a target annulus region between the completion string and the inner surface of the wellbore is filled with a gravel pack. Also, FIG. 2B shows the swellable element 104 in its swelled state to provide zonal isolation between different zones.

Figure 3:
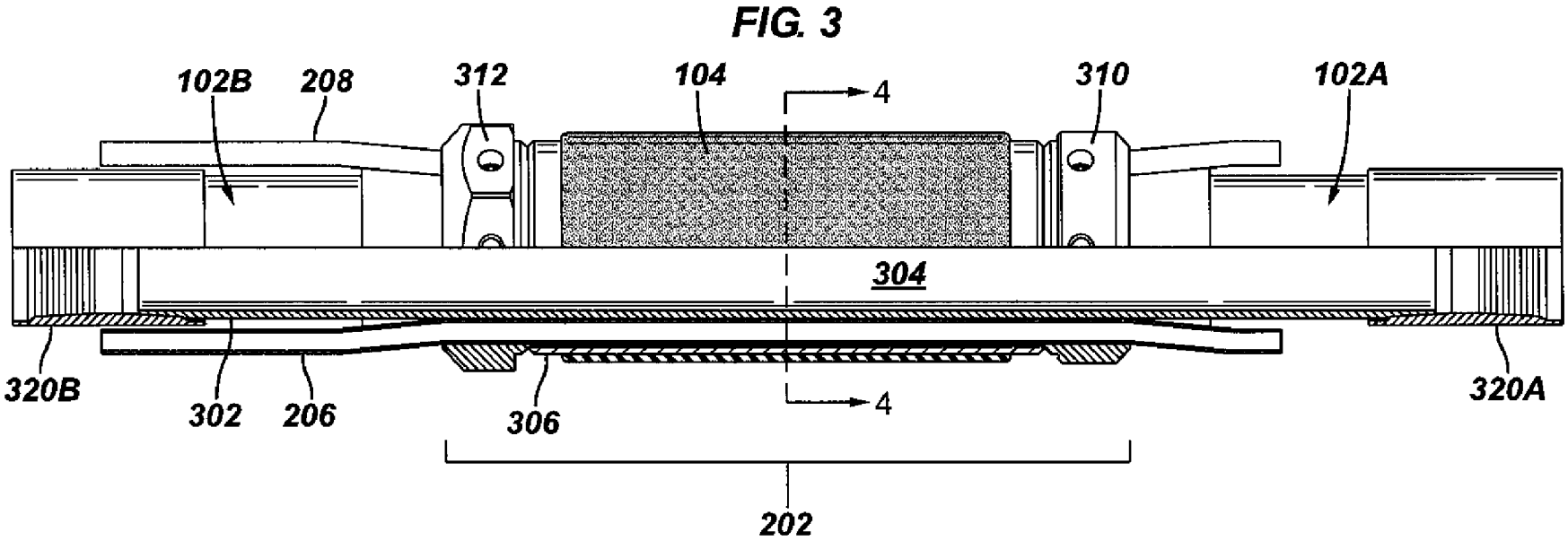
FIG. 3 is a partial longitudinal sectional view of a section of the completion string portion of FIGS. 2A-2B.
Figure 4:
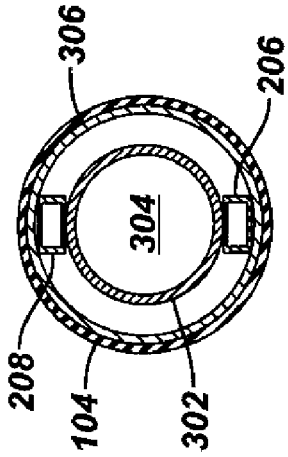
FIG. 4 is a cross-sectional view of a section of the completion string of FIG. 3.

FIG. 3 provides a partial longitudinal sectional view of a section of the completion string portion depicted in FIGS. 2A-2B. FIG. 4 is a cross-sectional view of a section of the completion string that includes the swellable element 104. As depicted in FIGS. 3 and 4, the connection sub 202 includes an inner pipe portion 302 (or inner mandrel) that defines an inner axial bore 304 through the connection sub 202. The connection sub 202 also has an outer shell or sleeve 306 that surrounds the pipe portion 302. The swellable element 104 is mounted on the outer surface of the outer shell 306. The shunt tubes 206, 208 are positioned between the outer shell 306 and the pipe portion 302. The tubing portion 302 and the outer shell 306 define an annular path 308 through the connection sub 202 to allow for the shunt tubes 206, 208 to pass through the connection sub 202.

The connection sub 202 has a first connector 310 to connect the connection sub 202 to the first screen assembly 102A, and a second connector 312 to connect the connection sub 202 to the second screen assembly 102B.

The pipe portion 302 of the connection sub 202 is connected (such as threadably connected) to pipe portions 320A and 320B of the screen assemblies 102A and 102B, respectively. The inner bores of the pipe portions 302, 320A, and 320B are axially aligned to permit a continuous axial flow of fluid through the completion string.

Figure 5:
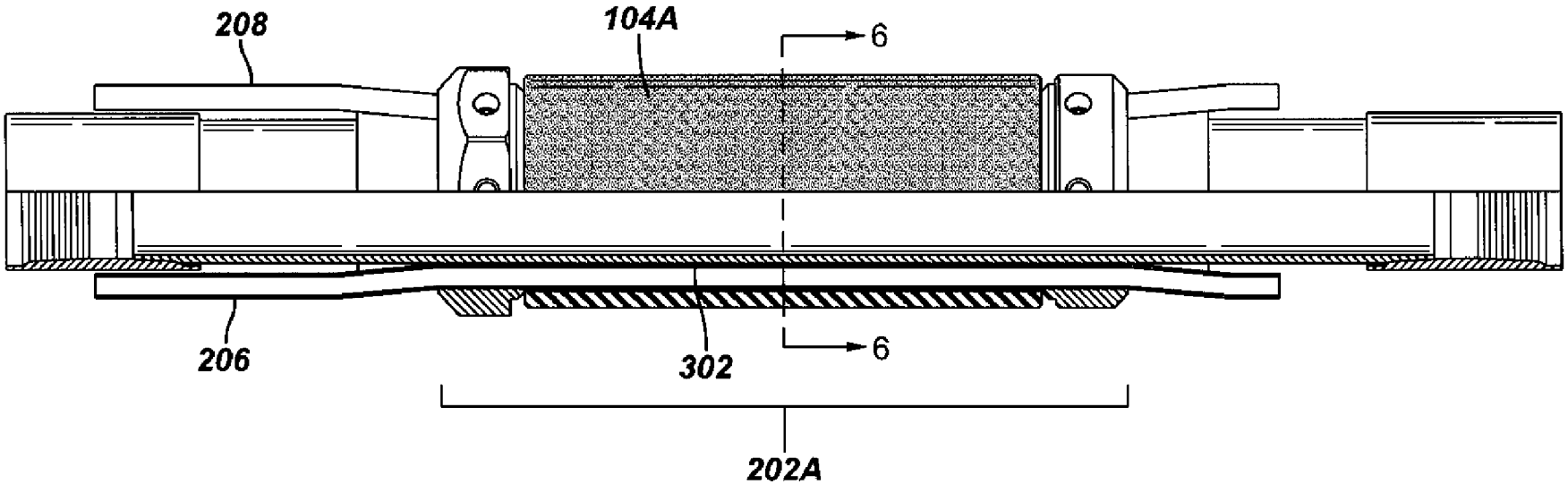
FIG. 5 is a partial longitudinal sectional view of a section of another embodiment of the completion string portion of FIGS. 2A-2B.
Figure 6:
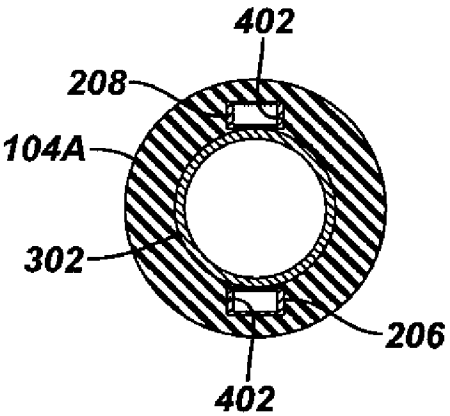
FIG. 6 is a cross-sectional view of a section of the completion string of FIG. 5.

A variant of the connection sub (202A) is depicted in FIGS. 5 and 6. FIG. 5 is a partial longitudinal sectional view of a section of the completion string portion depicted in FIG. 2A, and FIG. 6 is a cross-sectional view of a portion of the connection sub 202A. The connection sub 202A does not include an outer sleeve or shell, as in the FIG. 4 embodiment. Instead, the swellable element 104A in FIG. 5 is attached to the outer surface of the tubing portion (or inner mandrel) 302. The swellable element 104A defines axial paths 402 through which shunt tubes 206, 208 can extend.

In another implementation, instead of running the shunt tubes 206, 208 through the swellable element 104A, it is noted that the axial paths 402 through the swellable element 104A can form part of the shunt conduit; in other words, the axial paths 402 in the swellable element 104A are in fluid communication with the inner bores of the shunt tubes 206, 208 so that the axial paths and shunt tubes collectively form the shunt conduits. In such an implementation, the shunt tubes 206, 208 are inserted partially into the axial paths 402 of the swellable element 104A.

Figure 7:
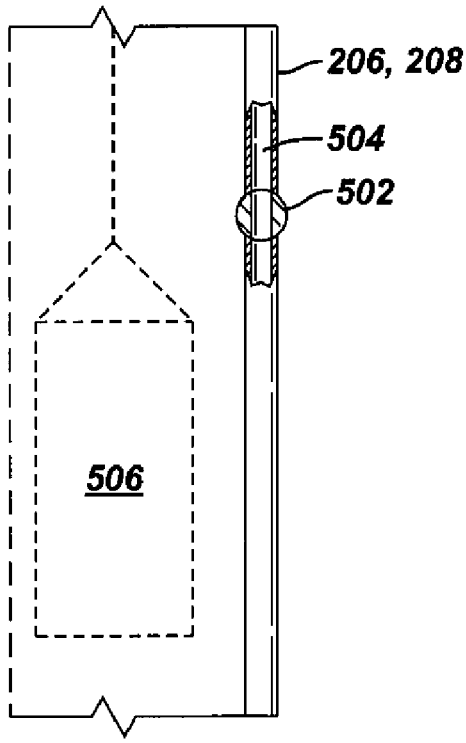
FIG. 7 illustrates a shunt tube with a valve therein, where the shunt tube is useable in the completion string of FIG. 1.

In some embodiments, as depicted in FIG. 7, a valve 502 can be provided in the shunt tube 206, 208. The valve 502 when opened allows for gravel slurry to flow through an inner bore 504 of the shunt tube 206, 208. When closed, the valve 502 blocks the communication of fluid through the bore 504 of the shunt tube 206, 208. The valve 502 can be closed after the gravel packing operation to prevent fluid communication between different zones of the well. Actuation of the valve 502 can be accomplished by moving a shifting tool 506 inside the completion string, where the shifting tool mechanically interacts with the valve 502 to open or close the valve 502.

In operation, a completion string including the components depicted in FIG. 1 is run into the wellbore 100, with the swellable elements 104 in a retracted position such that a radial clearance is provided between the swellable elements 104 and the inner surface 106 of the wellbore 100. When the position of the completion string is set, the gravel packing operation can proceed. Gravel slurry is pumped from the earth surface, either down the inner bore of the completion string or through an upper annulus region between the completion string and the wellbore 100. The gravel slurry flows through a cross-over device (not shown) to allow for the gravel slurry to enter a target annulus region 114 (FIG. 1) that is to be gravel packed. If gravel bridges were to form, gravel slurry can flow inside the shunt tubes 206, 208 to fill voids in the target annulus region 114 caused by the gravel bridges. Once the gravel packing operation is complete, the swellable elements 104 are allowed to swell using a chemical swelling process. The swelling can take a relatively long time, such as on the order of hours, days, or even weeks. In a different implementation, the swelling can be performed quickly. Once the swellable elements 104 engage the inner surface 106 of the wellbore 100, zonal isolation is accomplished.

A benefit of using the swellable elements 104 in the completion string is that swelling of the swellable elements 104 can be accomplished without using mechanical actuation elements. The presence of mechanical actuation elements is undesirable due to the presence of the shunt tubes.

Since the swellable elements 104 are in their retracted state during the gravel packing operation, the multiple zones of the target annulus region 114 can be gravel packed with the same gravel packing treatment; in other words, multiple treatments of multiple corresponding zones can be avoided. Also, there is no leak-off facility along the length of each sealing element 104 so that the gravel slurry is not dehydrated in the annulus segment 105 (FIG. 1) between the sealing element 104 and the inner surface 106 of the wellbore 100. This provides for clear segments (clear of gravel material) between the zones to be gravel packed so that the sealing elements 104 can expand in such segments 105 to seal against the inner surface 106 of the wellbore 100.

Moreover, the outer diameter of each swellable element 104 can be increased to slightly larger than the surrounding screen assemblies during the gravel pack operation. The enlarged outer diameter of the sealing elements 104 allows for an increase in the local velocity of the gravel slurry around each swellable element to prevent gravel from dropping out of the carrier fluid in the corresponding annular segment 105 between the swellable element 104 and the wellbore surface 106.

Note that optionally, a diverter (which can be in the form of a cup packer, for example) can be added to the top of (or otherwise proximate) the swellable packer nearest the toe of the well (the part of the well farthest away from the earth surface) to divert gravel slurry into the shunts and to avoid or reduce the chance of flowing slurry past or around the swellable packer nearest the toe of the well.

While the invention has been disclosed with respect to a limited number of embodiments, those skilled in the art, having the benefit of this disclosure, will appreciate numerous modifications and variations therefrom. It is intended that the appended claims cover such modifications and variations as fall within the true spirit and scope of the invention.

What is claimed is:

1. A gravel pack apparatus for use in a wellbore, comprising:

a screen assembly to filter particulates;

at least one shunt conduit to carry gravel slurry; and a swellable element, wherein the swellable element is formed of a material to swell in a presence of an activating agent to seal against the wellbore, wherein the swellable element when swelled expands radially outwardly, and wherein at least one axial path is defined in the material of the swellable element such that one or more walls of the axial path are provided by the material, the at least one axial path to provide a portion of the at least one shunt conduit.

2. The gravel pack apparatus of claim 1, wherein the swellable element is formed of an elastomer that swells in response to exposure to a downhole environment, wherein the at least one axial path is formed in the elastomer.

3. The gravel pack apparatus of claim 1, wherein the swellable element has a first diameter prior to swelling, and a second, larger diameter after swelling.

4. The gravel pack apparatus of claim 1, wherein the shunt conduit has a flow control device to control fluid flow through an inner bore of the shunt conduit.

5. The gravel pack apparatus of claim 4, further comprising a service tool moveable to actuate the flow control device of the shunt conduit between an open position and closed position.

6. The gravel pack apparatus of claim 1, further comprising:

another screen assembly; and a connection sub between the screen assemblies to interconnect the screen assemblies, wherein the connection sub comprises a tubing portion and an outer shell around the tubing portion, and wherein the at least one shunt conduit is positioned between the tubing portion and the outer shell.

7. The gravel pack apparatus of claim 6, wherein the swellable element is mounted on an outer surface of the outer shell.

8. The gravel pack apparatus of claim 6, wherein the screen assemblies include tubing portions that are axially aligned with the tubing portion of the connection sub such that a fluid flow path continuously extends through the tubing portions of the screen assemblies and connection sub.

9. The gravel pack apparatus of claim 1, further comprising:

another screen assembly; and a connection sub between the screen assemblies to interconnect the screen assemblies, wherein the connection sub has a tubing portion, and wherein the swellable element is mounted on the tubing portion.

10. The gravel pack apparatus of claim 9, wherein the shunt conduit comprises a shunt tube that extends through the axial path in the swellable element.

11. The gravel pack apparatus of claim 9, further comprising a shunt tube that is in fluid communication with the axial path in the swellable element, wherein the shunt tube and axial path together form the shunt conduit.

12. The gravel pack apparatus of claim 1, wherein the swellable element is chemically activated to well.

13. The gravel pack apparatus of claim 12, further comprising a mechanism to release an activating agent to chemically activate the swellable element.

14. A method for use in a wellbore, comprising:

running a tool string into the wellbore, wherein the tool string has a screen assembly, at least one shunt conduit, and a swellable element, wherein the swellable element is formed of a material that swells in a presence of an activating agent, and wherein at least one axial path is defined in the material of the swellable element such that one or more walls of the axial path are provided by the material, the at least one axial path to provide a portion of the at least one shunt conduit;

delivering gravel slurry through the at least one shunt conduit to perform gravel packing in the wellbore; and causing the swellable element to swell to seal against the wellbore.

15. The method of claim 14, wherein the swellable element has a diameter less than an inner diameter of the wellbore as the tool string is run into the wellbore.

16. The method of claim 14, wherein the swellable element expands radially outwardly to engage the wellbore after swelling.

17. The method of claim 14, wherein causing the swellable element to swell comprises exposing the swellable element to a downhole environment.

18. The method of claim 14, further comprising releasing an activating agent to chemically swell the swellable element.

19. The method of claim 14, further comprising closing a flow control device in the shunt conduit after gravel packing.

20. The method of claim 14, wherein causing the swellable element to swell is accomplished without mechanical activation of the swellable element.

21. The method of claim 14, wherein the tool string has plural swellable elements, the method further comprising:

providing a diverter proximate the swellable element at a toe of the well to divert gravel slurry into the at least one shunt conduit.

* * * * *